US008322461B2

(12) United States Patent
Hay et al.

(10) Patent No.: US 8,322,461 B2
(45) Date of Patent: Dec. 4, 2012

(54) DRILLING APPARATUS AND METHOD

(75) Inventors: Richard T. Hay, Spring, TX (US); Paul Botterell, Cheltenham (GB); Terence Schroter, Edmonton (CA); Nathan Strilchuk, Camrose (CA)

(73) Assignee: Halliburton Energy Services, Inc., Houston, TX (US)

( * ) Notice: Subject to any disclaimer, the term of this patent is extended or adjusted under 35 U.S.C. 154(b) by 511 days.

(21) Appl. No.: 12/264,827

(22) Filed: Nov. 4, 2008

(65) Prior Publication Data

US 2010/0108383 A1 May 6, 2010

(30) Foreign Application Priority Data

Nov. 3, 2008 (CA) ..... 2642713

(51) Int. Cl.
*E21B 7/08* (2006.01)

(52) U.S. Cl. ..... 175/45; 175/61; 175/74

(58) Field of Classification Search ..... 175/26, 175/45, 61, 74

See application file for complete search history.

(56) References Cited

U.S. PATENT DOCUMENTS

| | | | | |
|---|---|---|---|---|
| 3,713,500 | A * | 1/1973 | Russell | 175/73 |
| 3,896,667 | A | 7/1975 | Jeter | |
| 3,967,680 | A | 7/1976 | Jeter | |
| 4,655,289 | A | 4/1987 | Schoeffler | |
| 4,689,620 | A | 8/1987 | Wondrak | |
| 4,739,325 | A | 4/1988 | MacLeod | |
| 5,113,379 | A | 5/1992 | Scherbatskoy | |
| 5,237,540 | A | 8/1993 | Malone | |
| 5,249,161 | A | 9/1993 | Jones et al. | |
| 5,375,098 | A | 12/1994 | Malone et al. | |
| 5,485,889 | A | 1/1996 | Gray | |
| 5,493,288 | A | 2/1996 | Henneuse | |

(Continued)

FOREIGN PATENT DOCUMENTS

CA 2130282 2/1995

(Continued)

OTHER PUBLICATIONS

Halliburton 2003 Press Release, "Sperry-Sun continues to lead the industry in rotary steerable technology with the introduction of its Geo-Pilot Series II System", Feb. 20, 2003, 3 pages.

(Continued)

*Primary Examiner* — David Andrews

(74) *Attorney, Agent, or Firm* — Terrence N. Kuharchuk; William E. Shull; Clive D. Menezes

(57) ABSTRACT

A drilling apparatus includes an upper drill string, a lower drill string including a rotary drilling motor, an orientable rotatable connection between the drill strings, a reactive torque control device associated with the orientable rotatable connection, an orientation sensing device for providing a sensed actual orientation of the lower drill string, and a feedback control system configured to actuate the control device in response to the sensed actual orientation to achieve a target orientation of the lower drill string. A drilling method includes actuating the control device to prevent relative rotation of the drill strings, providing a sensed actual orientation of the lower drill string, comparing the sensed actual orientation with a target orientation of the lower drill string, actuating the control device to allow the lower drill string to rotate to provide the target orientation, and actuating the control device to prevent relative rotation of the drill strings.

71 Claims, 9 Drawing Sheets

U.S. PATENT DOCUMENTS

| | | | | |
|---|---|---|---|---|
| 5,579,283 | A | 11/1996 | Owens et al. | |
| 5,679,894 | A | 10/1997 | Kruger et al. | |
| 5,812,068 | A | 9/1998 | Wisler et al. | |
| 5,963,138 | A | 10/1999 | Gruenhagen | |
| 6,059,050 | A | 5/2000 | Gray | |
| 6,109,370 | A * | 8/2000 | Gray | 175/61 |
| 6,158,533 | A | 12/2000 | Gillis et al. | |
| 6,167,969 | B1 | 1/2001 | Schoeffler | |
| 6,216,802 | B1 | 4/2001 | Sawyer | |
| 6,233,524 | B1 | 5/2001 | Harrell et al. | |
| 6,244,361 | B1 | 6/2001 | Comeau et al. | |
| 6,267,185 | B1 | 7/2001 | Mougel et al. | |
| 6,269,892 | B1 | 8/2001 | Boulton et al. | |
| 6,272,434 | B1 | 8/2001 | Wisler et al. | |
| 6,273,190 | B1 | 8/2001 | Sawyer | |
| 6,382,332 | B1 | 5/2002 | Eaton | |
| 6,513,606 | B1 | 2/2003 | Krueger | |
| 6,571,888 | B2 | 6/2003 | Comeau et al. | |
| 6,978,850 | B2 | 12/2005 | Sawyer | |
| 7,324,907 | B2 | 1/2008 | Joublin et al. | |
| 2002/0140573 | A1 | 10/2002 | Carstensen et al. | |
| 2003/0010534 | A1 | 1/2003 | Chen et al. | |
| 2003/0016164 | A1 | 1/2003 | Finke et al. | |
| 2003/0026169 | A1 | 2/2003 | Schultz | |
| 2003/0056963 | A1 | 3/2003 | Wenzel | |
| 2003/0142586 | A1 | 7/2003 | Shah et al. | |
| 2007/0181343 | A1 * | 8/2007 | Russell et al. | 175/74 |

FOREIGN PATENT DOCUMENTS

| | | |
|---|---|---|
| CA | 2255299 | 7/1999 |
| CA | 2195002 | 6/2000 |
| CA | 2418717 | 8/2004 |
| CA | 2446097 | 5/2005 |
| EP | 0636763 | 2/1995 |
| EP | 0744527 | 11/1996 |
| EP | 0617196 | 6/2000 |
| FR | 2777594 | 10/1999 |
| GB | 2333785 | 8/1999 |
| GB | 2356207 | 5/2001 |
| WO | 9715749 | 5/1997 |
| WO | 0065198 | 11/2000 |
| WO | 0111191 | 2/2001 |
| WO | 0212676 | 2/2002 |
| WO | 2009039448 A2 | 3/2009 |

OTHER PUBLICATIONS

Sperry-Sun Drilling Services Technology Update, "Coiled Tubing BHA Orienter for Directional and Horizontal Drilling", Winter 1995, 4 pages.

Baker-Hughes Brochure entitled "OrientXPress", 2000, 2 pages.

Schlumberger Brochure entitled "CT Express", Jun. 2001, 2 pages.

* cited by examiner

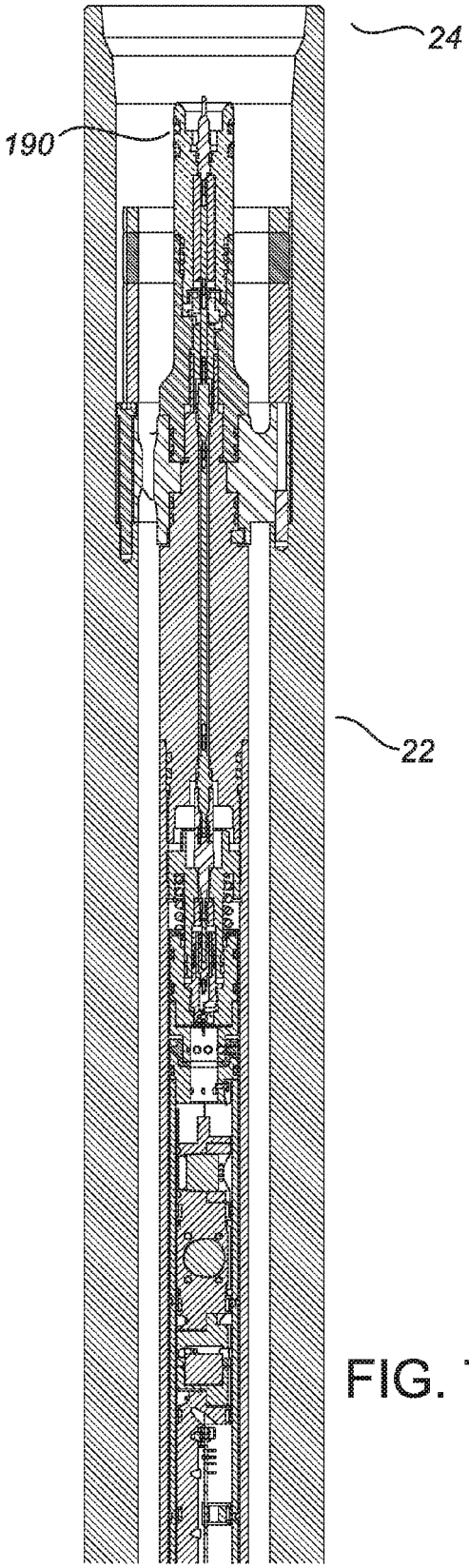
FIG. 7A
FIG. 7B
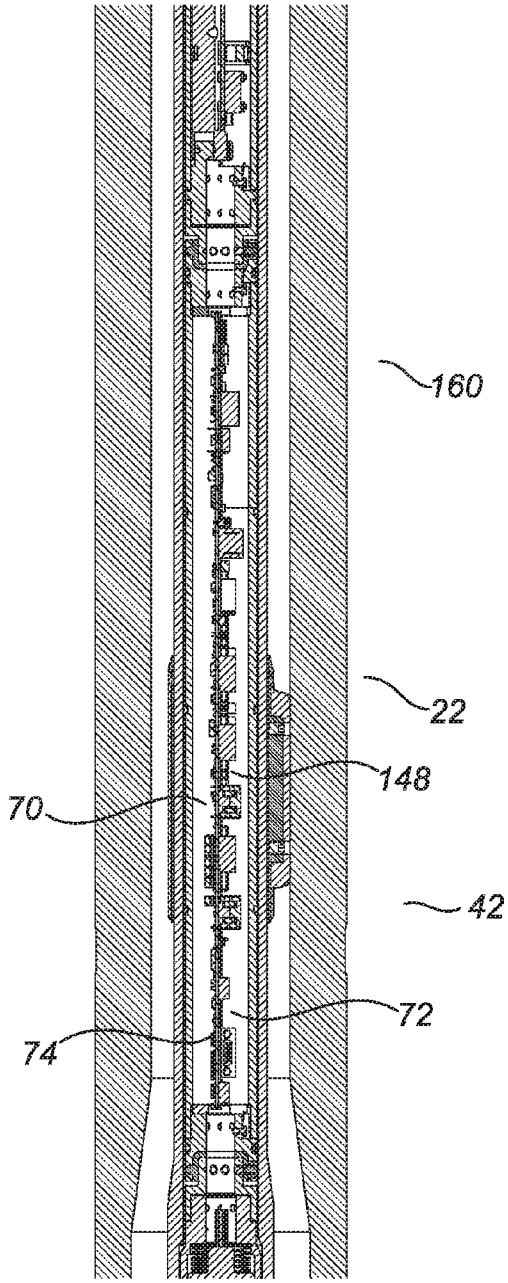

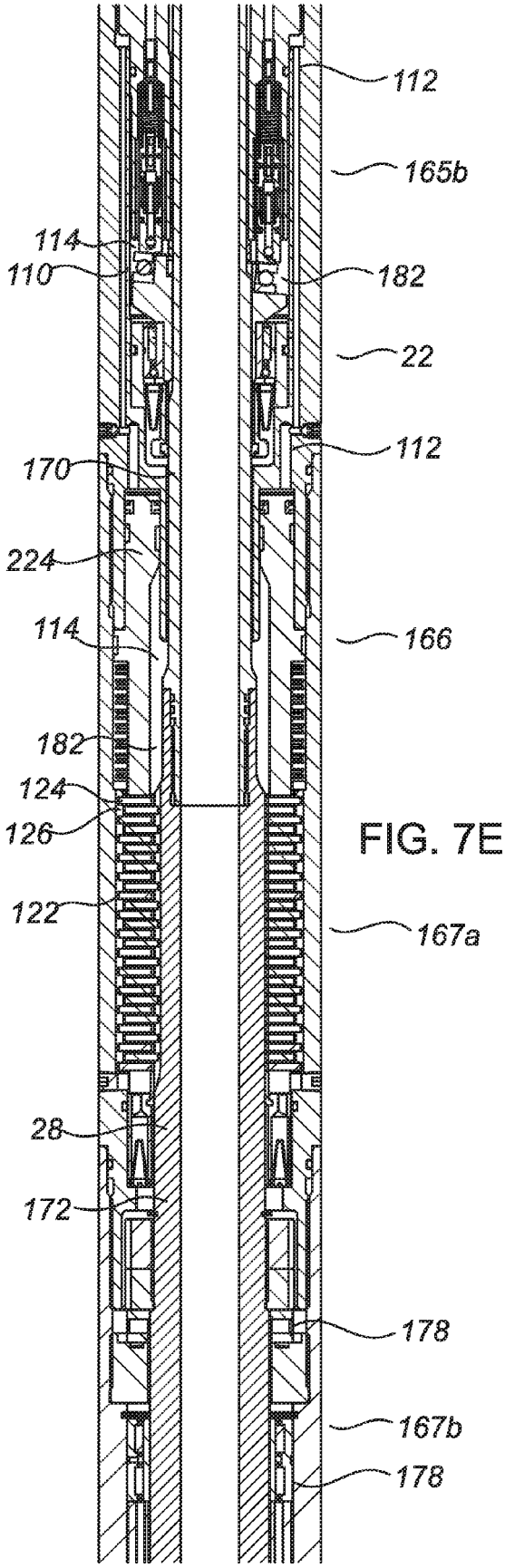
FIG. 7E
FIG. 7F
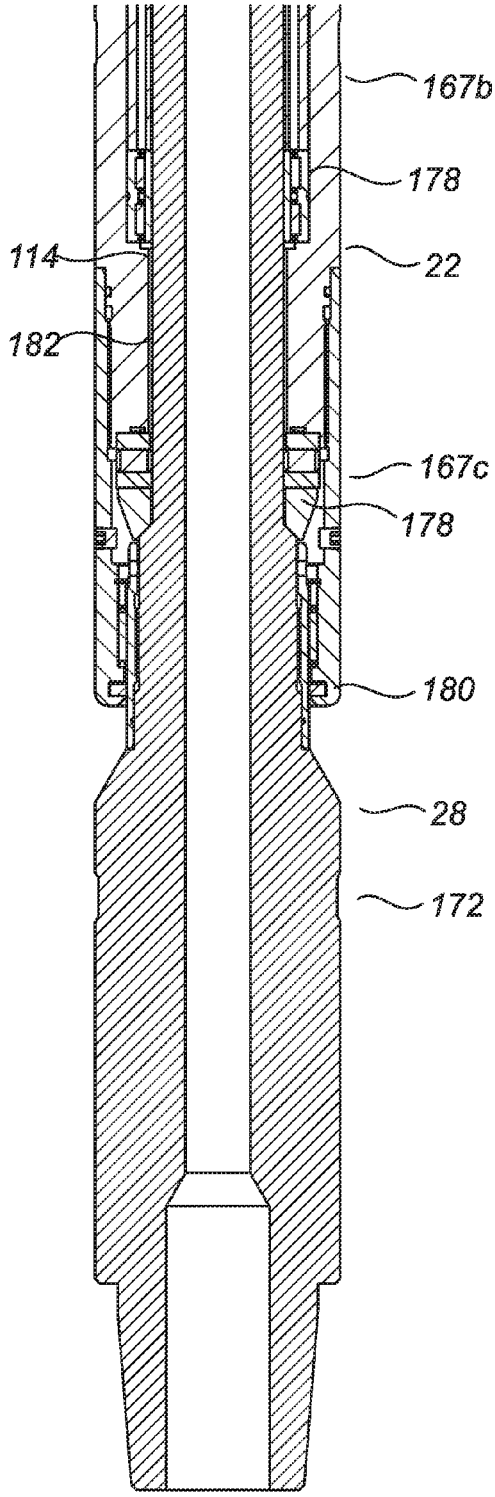

DRILLING APPARATUS AND METHOD

TECHNICAL FIELD

An apparatus and a method for use in drilling a borehole.

BACKGROUND OF THE INVENTION

Drilling of subterranean boreholes is often performed by rotating a drill bit which is located at a distal end of a drilling string. The drill bit may be rotated by rotating the entire drill string from a surface location and/or by using a rotary drilling motor which is connected with the drilling string and which is located adjacent to the drill bit.

The drilling string may be made up of individual joints of drilling pipe which are connected together to form the drilling string. Alternatively, the drilling string may be made up of a continuous length of coiled tubing which is stored on a large spool.

When the drilling string is made up of individual joints of drilling pipe, the entire drill string may be rotated with relative ease using a rotary table or a top drive on the drilling rig. When the drilling string is made up of a continuous length of coiled tubing, it is relatively more difficult to rotate the entire drill string because the spool must also be rotated.

Drilling while rotating the drill bit only by rotating the entire drilling string is often referred to as "rotary drilling". Drilling while rotating the drill bit only with a rotary drilling motor is often referred to as "sliding drilling". Drilling while rotating the drill bit both by rotating the entire drilling string and with a rotary drilling motor is often referred to as "performance drilling".

Directional drilling involves "steering" the drill bit so that the drill bit drills along a desired path. Directional drilling therefore requires a mechanism for orienting the drill bit so that it drills along the desired path. The orientation of the drill bit during directional drilling is often referred to as a "toolface orientation".

Directional drilling may be performed using a bend in the drilling string or using a steering tool which is associated with the drilling string.

If directional drilling is performed using a bend in the drilling string, the orientation of the bend must be controlled in order to provide a desired toolface orientation. As a result, steering with a bend in the drilling string may typically only be achieved during sliding drilling, since rotary drilling will result in a constant rotation of the bend and constant variation of the toolface orientation.

If directional drilling is performed using a steering tool, a desired toolface orientation may be achieved either by controlling the actuation of the steering tool or by maintaining the steering device at a fixed actuation and controlling the orientation of the steering tool in a similar manner as performing directional drilling with a bend in the drilling string.

Once selected, the toolface orientation may change in an undesired manner during drilling due to forces applied to the drill bit and the drilling string. These forces may be forces applied to the drill string from the surface location or may be reactive forces exerted on the drill bit and/or the drilling string by the borehole. As a result, it is often desirable to adjust the toolface orientation during directional drilling from time to time to account for such forces and for resulting undesired changes to the toolface orientation.

Reactive torque results from a reaction of the borehole to rotation of the drill bit against the distal end of the borehole. Reactive torque tends to rotate the drill bit in a direction opposite to that which is imposed upon the drill bit by rotation of the drill string and/or by a rotary drilling motor. Reactive torque may cause changes in the toolface orientation and also imposes potentially damaging stresses on the drilling string.

Efforts have been made to provide a drilling apparatus which controls the effects of reactive torque while facilitating directional drilling.

U.S. Pat. No. 5,485,889 (Gray) describes a drilling system and method for use with coiled tubing. The drilling system includes a control device. The control device includes a downstream section which is connected to a drilling tool having a bend axis, an upstream section which is connected to coiled tubing, and a swivel coupling assembly which connects the downstream section and the upstream section. A pump and a circuit are associated with the downstream section, the upstream section and the swivel coupling assembly so that relative rotation between the downstream section and the upstream section causes the pump to pump fluid through the circuit. A flow restricting orifice and a valve are provided in the circuit. The control device may be actuated to form a straight section of a borehole and a curved section of the borehole. In order to form the straight section of the borehole, the control device is actuated to permit relative rotation of the downstream section and the upstream section at a rate which is less than the rate of rotation of the drill bit. In order to form the curved section of the borehole, the control device is actuated to prevent relative rotation of the downstream section and the upstream section, thereby facilitating orientation of the bend axis of the drilling tool. Actuation of the control device to prevent relative rotation of the downstream section and the upstream section is achieved by actuating the valve to a closed position so that circulation of fluid through the circuit is prevented. The valve is actuated from the surface location through a control cable which extends to the surface location. A sensor communicates through the control cable with the surface location in order to communicate unspecified information to the surface location.

U.S. Pat. No. 6,059,050 (Gray) describes an apparatus for controlling relative rotation of a drilling tool due to reactive torque. The apparatus includes a first member and a second member which are relatively rotatable and a hydraulic pump having a first pump part mounted on the first member and a second pump part mounted on the second member. The pump is arranged such that relative rotation of the first and second members causes relative rotation of the first and second pump parts, which results in pumping of hydraulic fluid from a first chamber to a second chamber within which the hydraulic fluid is under pressure. A brake having a first brake part on the first member and a second brake part on the second member is associated with the second chamber such that the brake is actuated by the hydraulic pressure in the second chamber. A duct and a variable orifice control the flow of fluid from the second chamber back to the first chamber, thereby controlling the braking force exerted by the brake and the relative rotation of the first and second members. The apparatus may be actuated to permit or prevent relative rotation of the first and second members. Actuation of the apparatus to prevent relative rotation of the first and second members is achieved by actuating the variable orifice to a closed position so that the flow of fluid from the second chamber back to the first chamber is prevented. The variable orifice is controlled by an electrical control line from a suitable control system. A sensor communicates through the control cable with the surface location in order to communicate unspecified information to the surface location.

U.S. Pat. No. 6,571,888 (Comeau et al) describes an apparatus and a method for directional drilling with coiled tubing. The apparatus includes an uphole sub connected to coiled tubing, a downhole sub having a bent housing, a drill bit and a first motor for rotating the drill bit, a rotary connection between the uphole sub and the downhole sub for enabling rotation therebetween, and a clutch positioned between the rotary connection and the uphole sub. The clutch is operable between engaged and disengaged positions using fluid cycles applied alternately to engage and disengage the clutch. In the engaged position of the clutch, the downhole sub is rotatable relative to the uphole sub. In the disengaged position of the clutch, the downhole sub is locked against rotation relative to the uphole sub. The apparatus may be further comprised of a speed reducer for dissipating the reactive torque tending to rotate the downhole sub when the clutch is in the engaged position.

U.S. Patent Application Publication No. US 2003/0056963 A1 (Wenzel) describes an apparatus for controlling a downhole drilling motor assembly which includes a tubular housing, a mandrel rotatably mounted within the housing, and an hydraulic damper assembly disposed between the housing and the mandrel. The hydraulic damper assembly limits the rate of rotation of the mandrel within the housing in order to provide a preset resistance to reactive torque. The hydraulic damper assembly includes an annular body which is positioned within an annular chamber between the housing and the mandrel. The annular body is connected with the mandrel with splines so that the annular body rotates with the mandrel and can reciprocate axially relative to the mandrel. A guide track on the exterior surface of the annular body engages with guide members on the housing. The guide track has a zig-zag pattern which causes the annular body to reciprocate axially in the annular chamber as the housing rotates relative to the mandrel. The annular chamber is filled with hydraulic fluid. The annular body is provided with hydraulic valves which provide a restricted flow of the hydraulic fluid through the annular body as the annular body reciprocates within the annular chamber, thereby providing the preset resistance which limits the rate of rotation of the mandrel within the housing. The apparatus may be actuated to permit or prevent rotation of the mandrel within the housing. Actuation of the apparatus to prevent rotation of the mandrel within the housing may be achieved by actuating an annular plug to block the hydraulic valves, by actuating a clutch between the mandrel and the housing to lock the mandrel and housing together, or by actuating an electric valve to block the movement of hydraulic fluid within the annular chamber.

BRIEF DESCRIPTION OF DRAWINGS

Embodiments of the invention will now be described with reference to the accompanying drawings, in which:

FIG. 7 is a longitudinal section assembly drawing of components of an embodiment of the apparatus of the invention, in which FIG. 7B is a continuation of FIG. 7A, FIG. 7E is a continuation of FIG. 7D, and FIG. 7F is a continuation of FIG. 7E.

DETAILED DESCRIPTION

The present invention is an apparatus and a method for use in drilling a borehole. The invention utilizes reactive torque to control the orientation of one or more components of a drilling string during drilling. The invention is particularly useful for controlling a toolface orientation in directional drilling.

As used herein, "upper" means relatively proximal and/or uphole and "lower" means relatively distal and/or downhole with respect to position within a drilling string or location within a borehole, relative to a surface location.

Figure 1:
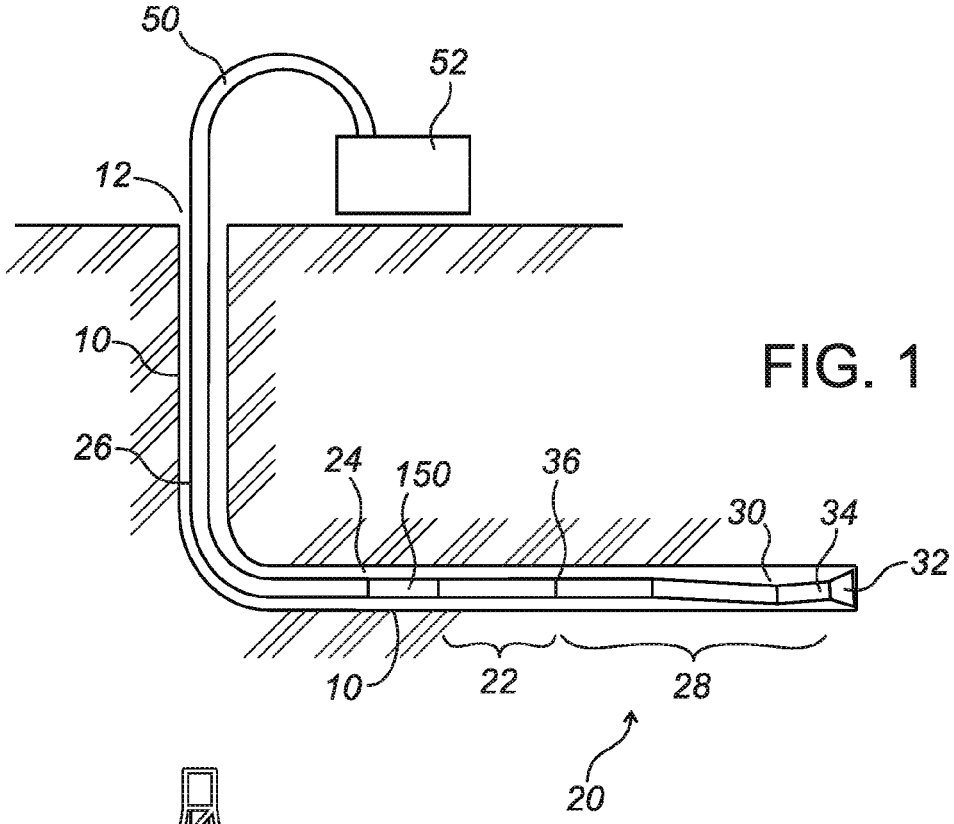
FIG. 1 is a schematic drawing of one embodiment of the apparatus of the invention connected with a drilling string in a borehole.

FIG. 1 provides a basic schematic view of one exemplary configuration of equipment which may be used to drill a borehole (10) from a surface location (12), including a schematic depiction of the apparatus (20) of the invention. The surface location (12) may be a ground surface, a drilling platform, or any other location outside of the borehole (10) from which drilling is controlled.

Referring to FIG. 1, an embodiment of the apparatus (20) of the invention is comprised of an upper assembly (22). The upper assembly (22) has an upper end (24) which is connected with a drilling string (26).

The apparatus is further comprised of a lower assembly (28). The lower assembly (28) includes a rotary drilling motor (30). The drilling motor (30) includes a drill bit (32) which is positioned at a lower end (34) of the lower assembly (28).

Figure 2:
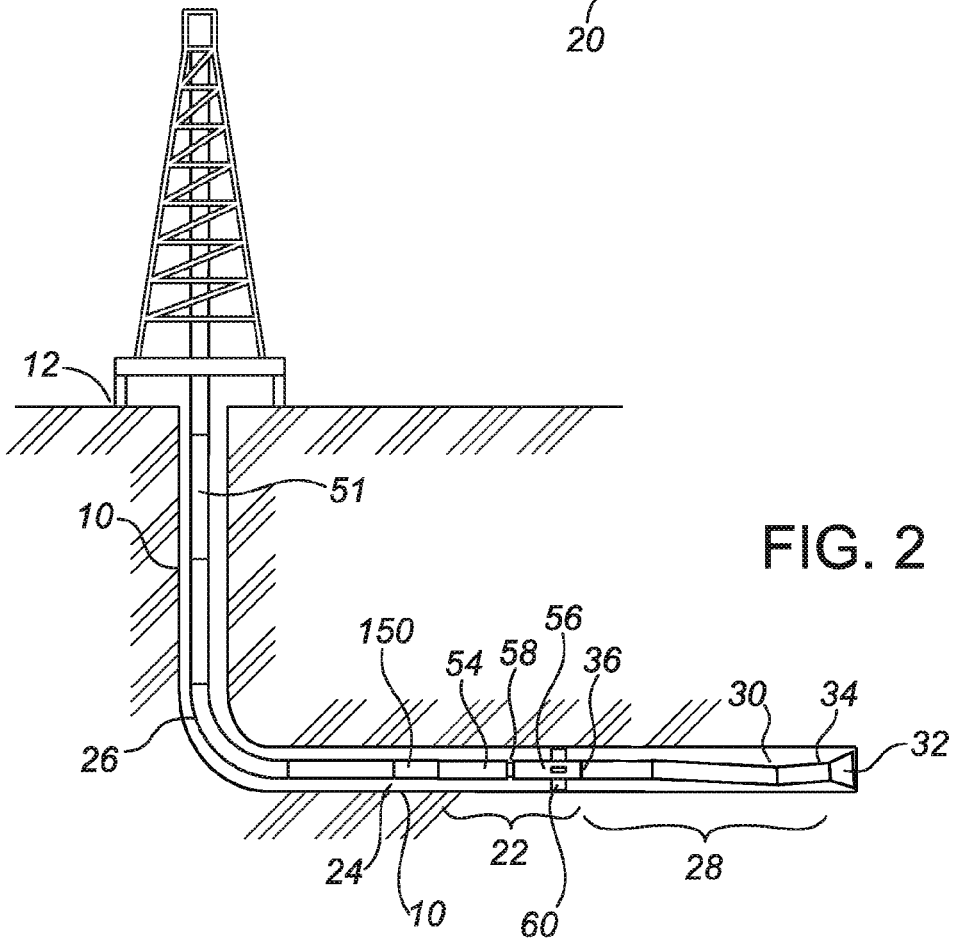
FIG. 2 is a schematic drawing of a second embodiment of the apparatus of the invention connected with a drilling string in a borehole.

The drilling string (26) may be comprised of a plurality of relatively short joints of pipe which are connected together, may be comprised of a single continuous length of pipe, or may be comprised of relatively long joints or lengths of pipe which are connected together. As depicted in FIG. 1, the drilling string (26) is comprised of a continuous length of pipe known as a coiled tubing (50). As depicted in FIG. 2, the drilling string (26) is comprised of relatively short joints of pipe (51) which are connected together.

Referring to FIG. 1, the coiled tubing (50) is stored on a spool (52) which is located at the surface location (12). If the length of a single spool (52) of coiled tubing (50) is not sufficient to complete the drilling operation, lengths of coiled tubing (50) may be connected together to form the drilling string (26).

In the embodiment depicted in FIG. 1, drilling is typically performed as sliding drilling wherein the drill bit (32) is rotated by the drilling motor (30) during drilling and the coiled tubing (50) is not rotated during drilling.

As depicted in FIG. 1, the upper assembly (22) is configured so that no portion of the upper assembly (22) is rotatable relative to the drilling string (26).

Referring to FIG. 2, in an alternate embodiment, the upper assembly (22) may be comprised of an upper section (54), a lower section (56) adjacent to the orientable rotatable connection (36), and a swivel connection (58) between the upper section (54) and the lower section (56) so that the upper section (54) is rotatable relative to the lower section (56). In the alternate embodiment depicted in FIG. 2, the lower section (56) may be comprised of a rotation restraining device (60) for restraining the lower section (56) of the lower assembly (28) from rotating relative to the borehole (10) during drilling.

The alternate embodiment depicted in FIG. 2 allows for the drilling string (26) to be rotated from the surface location (12) during drilling without rotating either the lower section (56) of the upper assembly (22) or the lower assembly (28), thus providing some of the known benefits of rotary drilling in the use of the invention.

Figure 3:
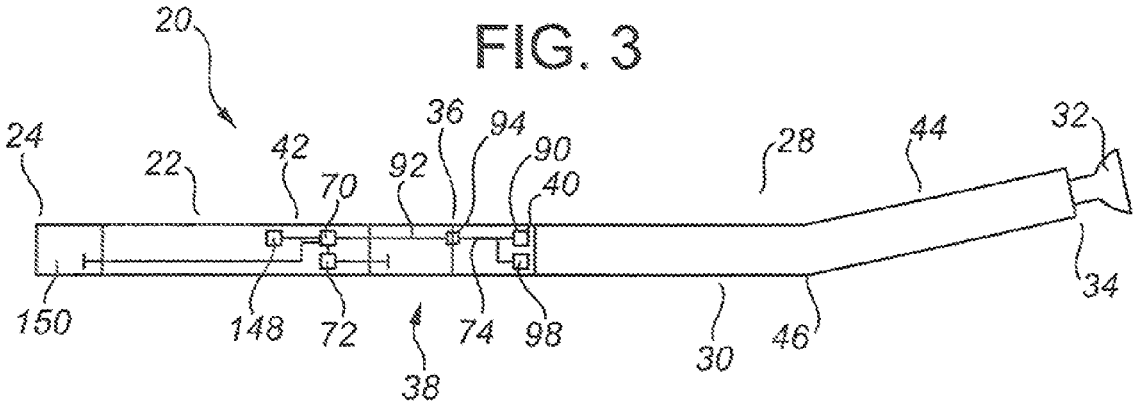
FIG. 3 is a schematic drawing of components of a one embodiment of the apparatus of the invention.
Figure 4:
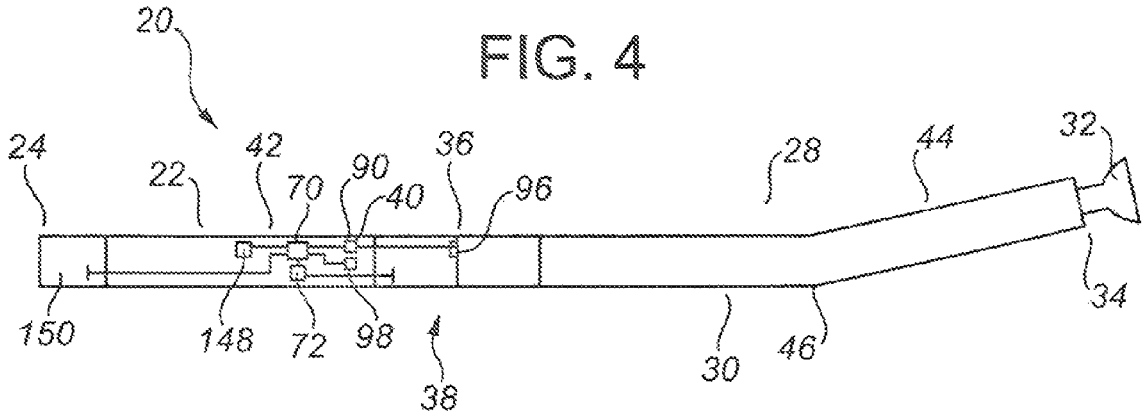
FIG. 4 is a schematic drawing of components of a second embodiment of the apparatus of the invention.

FIG. 3 and FIG. 4 provide more detailed schematic views of embodiments of the apparatus (20) of the invention in which components of the apparatus (20) are more fully depicted.

Referring to both FIG. 3 and FIG. 4, an orientable rotatable connection (36) is provided between the upper assembly (22) and the lower assembly (28).

A reactive torque control device (38) is associated with the orientable rotatable connection (36). The reactive torque control device (38) is actuatable to selectively allow rotation of the lower assembly (28) relative to the upper assembly (22) or prevent rotation of the lower assembly (28) relative to the upper assembly (22).

An orientation sensing device (40) provides a sensed actual orientation of the lower assembly (28).

A feedback control system (42) is associated with the reactive torque control device (38) and with the orientation sensing device (40). The feedback control system (42) is capable of actuating the reactive torque control device (38) in response to the sensed actual orientation of the lower assembly (28) in order to achieve a target orientation of the lower assembly (28).

In some embodiments, the lower assembly (28) provides a toolface orientation (44) to facilitate directional drilling. A desired toolface orientation (44) of the lower assembly (28) may be provided by the target orientation of the lower assembly (28). A desired toolface orientation (44) of the lower assembly (28) may be identical to the target orientation of the lower assembly (28) or may be referenced to the target orientation of the lower assembly (28).

The toolface orientation (44) may be provided in any manner and/or by any apparatus which enables the lower assembly (28) to provide the toolface orientation (44). For example, the toolface orientation (44) may be provided by a steering tool, where the term "steering tool" includes any apparatus which facilitates directional drilling by providing the toolface orientation (44).

In some embodiments, the toolface orientation (44) may be provided by a bend (46) associated with the lower assembly (28). The bend (46) may be provided by a bent sub, by a bent motor housing, or may be provided in any other suitable manner.

The feedback control system (42) may be comprised of any structure, device or apparatus or combination of structures, devices and apparatus which is capable of receiving input from the orientation sensing device (40) relating to the sensed actual orientation of the lower assembly (28) and actuating the reactive torque control device (38) in response to the input in order to achieve the target orientation of the lower assembly (28).

For example, referring to FIG. 3 and FIG. 4, in some embodiments the feedback control system (42) is comprised of a feedback processor (70) for processing the sensed actual orientation of the lower assembly (28) in order to generate a feedback actuation instruction for actuating the reactive torque control device (38) in order to achieve the target orientation of the lower assembly (28). The feedback control system (42) may also be comprised of a reactive torque control device controller (72) for receiving the feedback actuation instruction and for actuating the reactive torque control device (38) in order to implement the feedback actuation instruction. The feedback control system (42) may also be comprised of a feedback communication link (74) between the orientation sensing device (40) and the feedback processor (70), for transmitting the sensed actual orientation of the lower assembly (28) from the orientation sensing device (40) to the feedback processor (70).

The feedback processor (70) and the reactive torque control device controller (72) may be comprised of separate components or may be combined in a single apparatus or device.

The components of the feedback control system (42) may be associated with either the upper assembly (22) or the lower assembly (28). As depicted in FIG. 3 and FIG. 4, the components of the feedback control system (42) are associated with the upper assembly (22) so that the feedback control system (42) is a component of the upper assembly (22).

The orientation sensing device (40) may be comprised of any structure, device or apparatus which is capable of sensing the actual orientation of the lower assembly (28). The orientation sensing device (40) may be comprised of an orientation sensor (90). The orientation sensor (90) may be associated with either the upper assembly (22) or the lower assembly (28).

As previously described, the orientable rotatable connection (36) connects the upper assembly (22) and the lower assembly (28), with the result that the upper assembly (22) and the lower assembly (28) may rotate relative to each other. Consequently, there are advantages and disadvantages inherent in associating the orientation sensor (90) with either the upper assembly (22) or the lower assembly (28).

As one example, associating the orientation sensor (90) with the lower assembly (28) facilitates a direct determination of the sensed actual orientation of the lower assembly (28), but requires either that the feedback processor (70) be associated with the lower assembly (28) or that the feedback communication link (74) effect communication across the orientable rotatable connection (36). As a second example, associating the orientation sensor (90) with the upper assembly (22) enables the feedback processor (70) to be associated with the upper assembly (22) without requiring the feedback communication link (74) to effect communication across the orientable rotatable connection (36), but results in a sensed actual orientation of the upper assembly (22) which must somehow be referenced to the actual orientation of the lower assembly (28) in order to provide the sensed actual orientation of the lower assembly (28).

As a result, referring to FIG. 3, the orientation sensor (90) may be associated with the lower assembly (28) so that the orientation sensor (90) is a component of the lower assembly (28) and the feedback processor (70) is associated with the upper assembly (22) so that the feedback processor (70) is a component of the upper assembly (22). In this configuration, the sensed actual orientation of the lower assembly (28) may be directly determined by the orientation sensor (90), the feedback communication link (74) is comprised of a wireline (i.e., electrical cable) (92) between the orientation sensor (90) and the feedback processor (70), and a rotatable signal coupler (94) is provided between the orientation sensor (90) and the feedback processor (70) in order to effect communication across the orientable rotatable connection (36).

The rotatable signal coupler (94) may be comprised of a slip ring, an inductive coupling, or any other suitable coupler which is capable of communicating signals across the orientable rotatable connection (36). As depicted in FIG. 3, the rotatable signal coupler (94) is a slip ring.

Referring to FIG. 4, the orientation sensor (90) may alternatively be associated with the upper assembly (22) so that the orientation sensor (90) is a component of the upper assembly (22) and the feedback processor (70) is associated with the upper assembly (22) so that the feedback processor is a component of the upper assembly (22). In this configuration, the rotatable signal coupler (94) is not necessary, but the orientation sensor (90) provides a sensed actual orientation of the upper assembly (22). As a result, the orientation sensing device (40) is comprised of a referencing device (96) for providing a reference orientation between the upper assembly (22) and the lower assembly (28) so that the sensed actual orientation of the lower assembly (28) can be obtained from the sensed actual orientation of the upper assembly (22).

Referring to FIG. 3 and FIG. 4, the apparatus (20) may be further comprised of one or more parameter sensing devices (98) for sensing parameters other than the actual orientation of the lower assembly (28). Such parameters may relate to the apparatus (20), to the borehole (10) and/or surrounding formations, and/or to drilling performance. The parameter sensing devices (98) may be comprised of any suitable structures, devices or apparatus for sensing the desired parameters.

The reactive torque control device (38) may be associated with either or both of the upper assembly (22) and the lower assembly (28). In some embodiments, the reactive torque control device (38) is associated with the upper assembly (22) so that the reactive torque control device is a component of the upper assembly (22).

The reactive torque control device (38) may be comprised of any structure, device or apparatus or combination of structures, devices or apparatus which is capable of being actuated to selectively allow rotation of the lower assembly (28) relative to the upper assembly (28) or prevent rotation of the lower assembly (28) relative to the upper assembly (22). For example, the reactive torque control device (38) may be comprised of a device such as those described in U.S. Pat. No. 5,485,889 (Gray), U.S. Pat. No. 6,059,050 (Gray) or U.S. Pat. App. Pub. No. US 2003/0056963 A1 (Wenzel).

Figure 5:
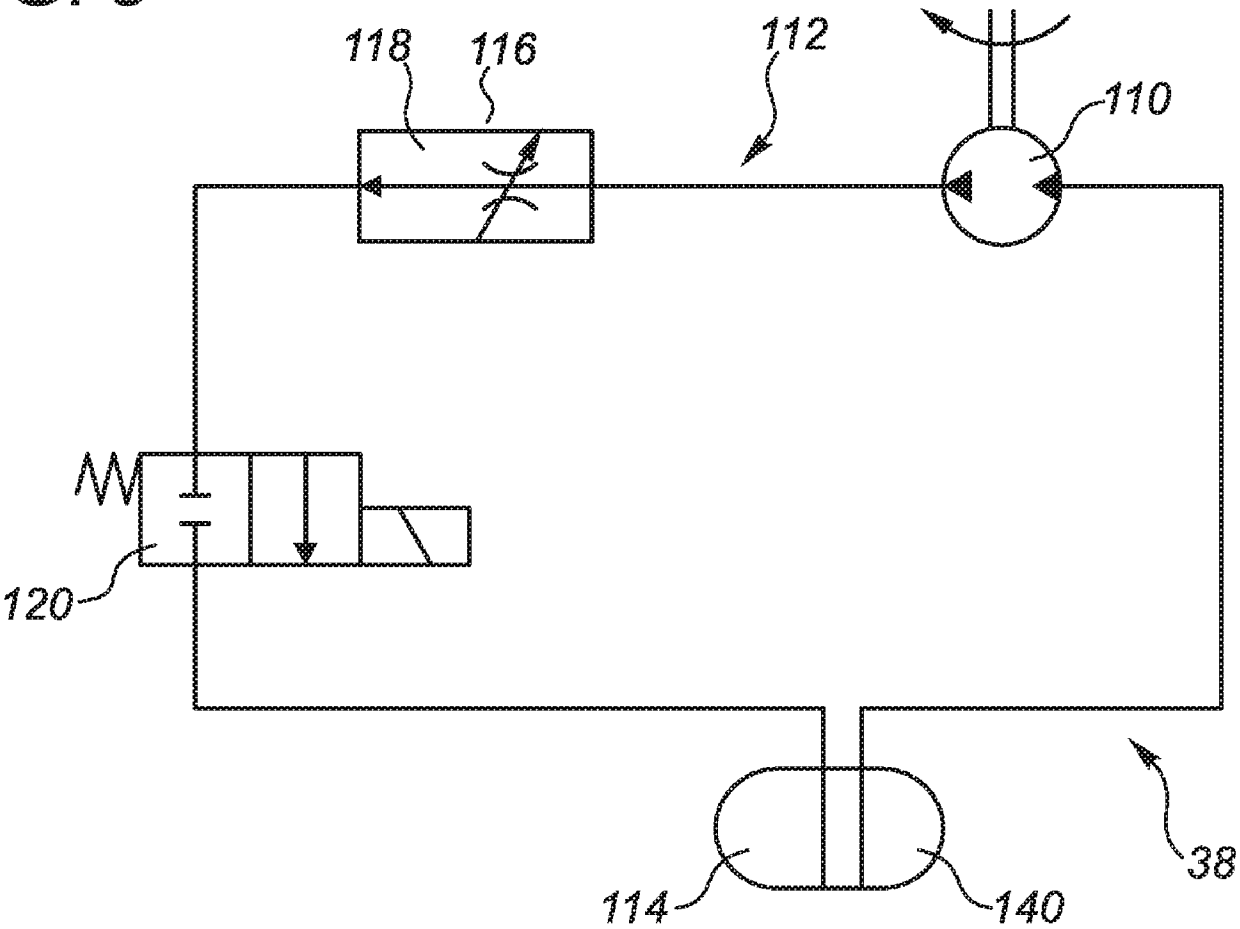
FIG. 5 is a hydraulic circuit diagram relating to a hydraulic circuit for use in one embodiment of a reactive torque control device according to the invention.

FIG. 5 provides a hydraulic circuit diagram for a first embodiment of the reactive torque control device (38).

Referring to FIG. 5, the reactive torque control device (38) may be comprised of a pump (110) and a loop (112) containing a pumping fluid (114), wherein the pump (110) pumps the pumping fluid (114) around the loop (112). As depicted in FIG. 5, the pump (110) is driven by relative rotation between the lower assembly (28) and the upper assembly (22). In other embodiments, the pump (110) may be driven by a power source other than the relative rotation between the lower assembly (28) and the upper assembly (22).

Referring to FIG. 5, the loop (112) is comprised of a pumping resistance (116). The pumping resistance (116) loads the pump (110) and thereby impedes the relative rotation between the lower assembly (28) and the upper assembly (22). The pumping resistance (116) may be adjustable. The pumping resistance (116) may be comprised of one or more flow restrictors (118) positioned in the loop (112).

The one or more flow restrictors (118) may be adjustable in order to adjust the pumping resistance (116). The one or more flow restrictors (118) may be adjustable by the reactive torque control device controller (72), or may be manually adjustable.

Referring to FIG. 5, the loop (112) may be selectively blocked in order to prevent the pumping fluid (114) from being pumped around the loop (112) by the pump (110). The reactive torque control device (38) may therefore be further comprised of one or more valves (120) positioned in the loop (112). The one or more valves (120) may be actuatable between an open position and a closed position in which the loop (112) is blocked in order to prevent the pumping fluid (114) from being pumped around the loop (112) by the pump (110).

The one or more valves (120) may be actuatable by the reactive torque control device controller (72). The one or more valves (120) may be solenoid type valves or any other suitable type of valve.

The pump (110) may be comprised of any type of pump which is suitable for pumping the pumping fluid around the loop (112). In embodiments where the pump (110) is driven by relative rotation between the lower assembly (28) and the upper assembly (22), the pump (110) may be a swash plate type pump. A low pressure reservoir (140) is included in the loop (112) to provide a source of the pumping fluid (114) for the pump (110).

Figure 6:
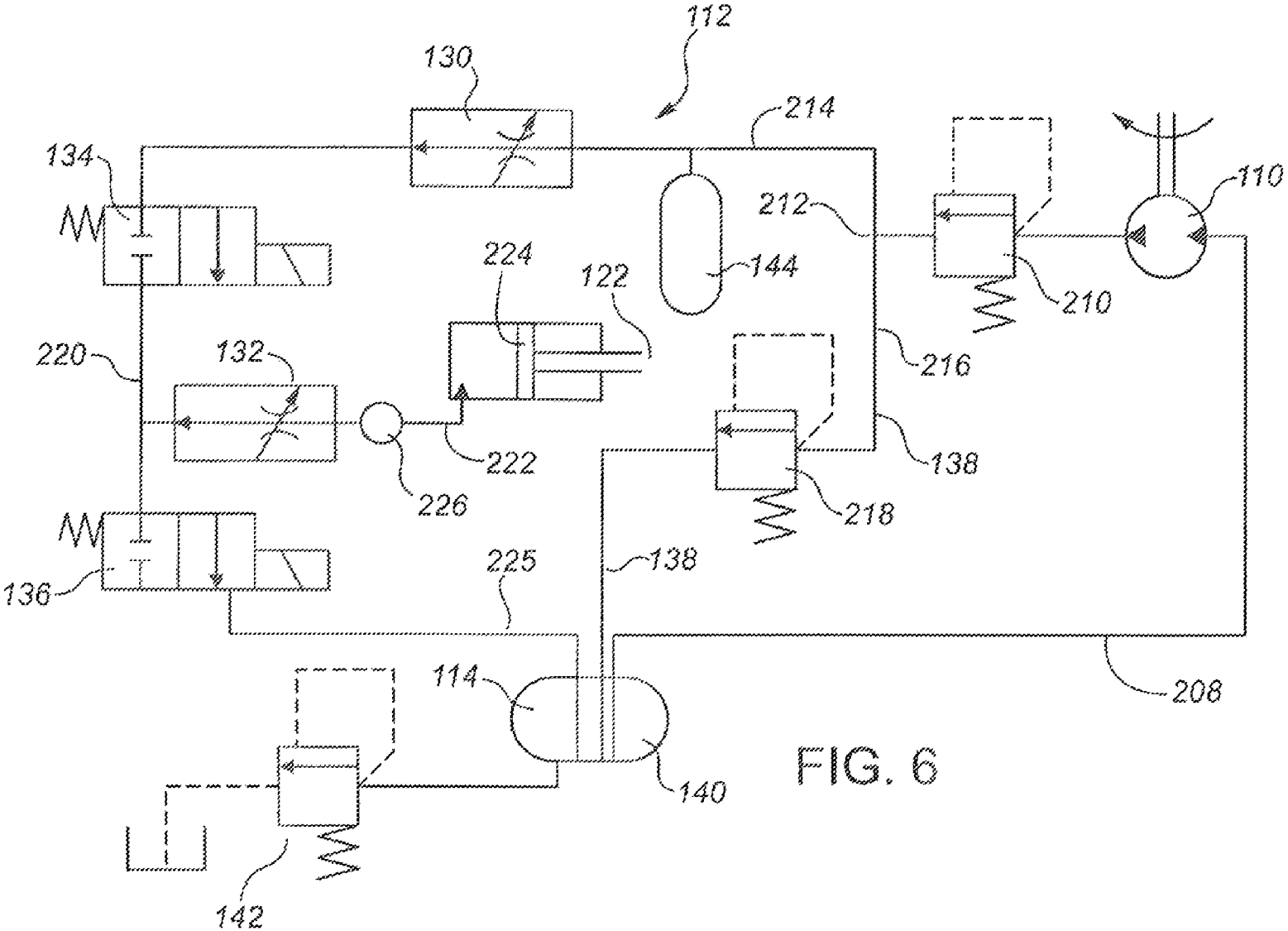
FIG. 6 is a hydraulic circuit diagram relating to a hydraulic circuit for use in a second embodiment of a reactive torque control device according to the invention.

FIG. 6 provides an hydraulic circuit diagram for a second embodiment of the reactive torque control device (38).

Referring to FIG. 6, the reactive torque control device (38) may be further comprised of a brake (122) which is associated with the loop (112). The brake (122) may be comprised of any structure, device or apparatus which is capable of providing a braking force between the upper assembly (22) and the lower assembly (28) in order to impede or prevent relative rotation between the lower assembly (28) and the upper assembly (22). As non-limiting examples, the braking force may be a frictional force, a magnetic force, an electromagnetic force, or a viscous fluid force, and the brake (122) may be comprised of any suitable braking mechanism and/or a clutch mechanism which may be adapted to be associated with the loop (112).

As depicted in FIG. 6, the brake (122) may be comprised of a first brake part (124) associated with the upper assembly (22) and a second brake part (126) associated with the lower assembly (28). The brake (122) may be actuated by a fluid pressure in the loop (112). The brake parts (124,126) may be urged into engagement with each other as a result of the fluid pressure in the loop (112), thereby providing an engagement force between the brake parts (124,126) which impedes the relative rotation between the lower assembly (28) and the upper assembly (22). The engagement force between the brake parts (124,126) may increase as the fluid pressure in the loop (112) increases.

Referring to FIG. 6, the pumping resistance (116) in the loop (112) may be comprised of a first flow restrictor (130) positioned in the loop (112) on an upstream side of the brake (122) and a second flow restrictor (132) positioned in the loop (112) on a downstream side of the brake (122).

Referring to FIG. 6, the reactive torque control device (38) may be comprised of a first valve (134) positioned in the loop (112) on the upstream side of the brake (122) and a second valve (136) positioned in the loop (112) on the downstream side of the brake (122). The valves (134,136) may each be actuated between an open position and a closed position in which the loop (112) is blocked between the first valve (134) and the second valve (136) in order to maintain the engagement force between the brake parts (124,126). The valves (134,136) may be actuatable by the reactive torque control device controller (72).

Referring to FIG. 6, the loop (112) may be comprised of a pressure relief bypass line (138) positioned in the loop (112), for bypassing the first valve (134) and the second valve (136) when the fluid pressure in the loop (112) exceeds a bypass pressure as determined by the pressure relief bypass line (138). As depicted in FIG. 6, the pressure relief bypass line (138) leads to the low pressure reservoir (140) which provides the pumping fluid (114) to the pump (110).

Referring to FIG. 6, the loop (112) may be further comprised of a dump valve (142) for releasing an amount of the pumping fluid (114) from the loop (112) when the fluid pressure in the loop (112) exceeds a dump pressure as determined by the dump valve (142).

Referring to FIG. 6, the reactive torque control device (38) may be further comprised of an accumulator (144) in communication with the loop (112), for supplying additional pumping fluid (114) to the loop (112) when the fluid pressure in the loop (112) is below an accumulator threshold pressure as determined by the accumulator (144).

The reactive torque control device (38) may be actuatable between a first position which provides a minimum resistance to relative rotation between the lower assembly (28) and the upper assembly (22), thereby allowing relative rotation between the lower assembly (28) and the upper assembly (22), and a second position which provides a maximum resistance to relative rotation between the lower assembly (28) and the upper assembly (22), thereby preventing relative rotation between the lower assembly (28) and the upper assembly (22).

In some embodiments, the reactive torque control device (38) may be actuatable to one or more intermediate positions between the first position and the second position, wherein the intermediate positions provide an intermediate resistance to rotation of the lower assembly (28) relative to the upper assembly (22). The intermediate positions may permit the lower assembly (28) to rotate relative to the upper assembly (22) at a rate which is slower than that permitted by the first position.

Depending upon the embodiment of the invention, the reactive torque control device (38) may be actuated amongst the first position, the second position and the intermediate positions by adjusting the pumping resistance (116) in the loop (112) and/or by actuating the one or more valves (120, 134,136).

Referring to FIG. 3 and FIG. 4, the feedback control system (42) may be further comprised of a memory (148). The memory (148) may be used to store any desired data, including data relating to the apparatus (20) and/or its operation, the borehole (10) and/or surrounding formations, and/or drilling performance. For example, the memory (148) may be used to store one or more target orientations of the lower assembly (28), a detailed borehole drilling plan for the apparatus (20), data collected by sensing devices (40,98) during the operation of the apparatus (20), or instructions in downlink communications provided from the surface location (12) during operation of the apparatus (20). The data may be stored in the memory (148) for later retrieval when the apparatus (20) is returned to the surface location (12), and/or the data may be used by the feedback control system (42) to control the actuation of the reactive torque control device (38).

The apparatus (20) may be operated in several different modes.

As one example, the apparatus (20) may be operated in a fully automated closed-loop mode in which the feedback control system (42) utilizes data contained in the memory (148), such as a detailed borehole drilling plan including a sequence of target orientations of the lower assembly (28), data received from the orientation sensing device (40) and/or data received from parameter sensing devices (98) in order to control the operation of the apparatus (20) without input or intervention from the surface location (12).

As a second example, the apparatus (20) may be operated in a fully manual mode in which the reactive torque control device (38) is actuated by commands from the surface location (12), and in which the feedback control system (42) is effectively overridden by the commands. In this mode, the commands from the surface location (12) may follow the interpretation of data contained in uplink communications received at the surface location (12).

As a third example, the apparatus (20) may be operated in a variety of semi-automated closed-loop modes in which the feedback control system (42) achieves and maintains the target orientation of the lower assembly (28), but in which downlink communications can be provided to the feedback control system (42) and stored in the memory (148) in the form of downlink instructions relating to updated target orientations or drilling plans, in which the feedback control system (42) can be overridden from the surface location (12), and/or in which uplink communications can be provided to the surface location (12).

If the apparatus (20) is operated in the fully automated closed-loop mode, instructions in the form of target orientations and/or a detailed borehole drilling plan may be stored in the memory (148) at the surface location (12) before the apparatus (20) is deployed in the borehole (10), and data from the sensing devices (40,98) may also be stored in the memory (148) during the operation of the apparatus (20). As a result, in the fully automated closed-loop mode, there may be no need for either uplink or downlink communications between the apparatus (20) and the surface location (12).

If, however, the apparatus (20) is operated in the fully manual mode or in a semi-automated closed-loop mode, communication between the apparatus (20) and the surface location (12) is necessary.

Consequently, referring to FIG. 3 and FIG. 4, in some embodiments the apparatus (20) may be further comprised of a surface communication link (150) between the surface location (12) and the feedback control system (42), for communicating downlink communications and/or uplink communications between the surface location (12) and the feedback control system (42).

The downlink communications may be comprised of downlink instructions to the feedback control system (42) for actuating the reactive torque control device (38), such as for example one or more target orientations of the lower assembly (28).

The uplink communications may be comprised of data generated by the orientation sensing device (40) and/or data generated by parameter sensing devices (98).

The surface communication link (150) may be included as a dedicated component of the apparatus (20). Alternatively, the surface communication link (150) may be provided by a telemetry system of the type which is typically associated with the drilling string (26).

For example, the surface communication link (150) may be provided by a telemetry system such as a pressure pulse telemetry system, a fluid flowrate telemetry system comprising a turbine and a rotation sensor for sensing a rotational speed of the turbine, an electromagnetic (EM) telemetry system, an acoustic telemetry system, a wireline telemetry system, or any other type of telemetry system which is capable of communicating downlink communications and/or uplink communications between the surface location (12) and the feedback control system (42).

The telemetry system may be of the type typically described as a measurement-while-drilling (MWD) telemetry system, a logging-while-drilling (LWD) telemetry system or any other suitable type of telemetry system.

The telemetry system may be comprised of a telemetry system processor, and in some embodiments the feedback processor (70) may be comprised of the telemetry system processor so that the apparatus (20) does not include a dedicated feedback processor (70).

The telemetry system may be comprised of a telemetry system orientation sensor, and in some embodiments the orientation sensing device (40) may be comprised of the telemetry system orientation sensor so that the apparatus (20) does not include a dedicated orientation sensor (90).

In other embodiments, the telemetry system communicates with the feedback control system (42) and the orientation sensing device (40) which are included as dedicated components of the apparatus (20).

Figure 7C:
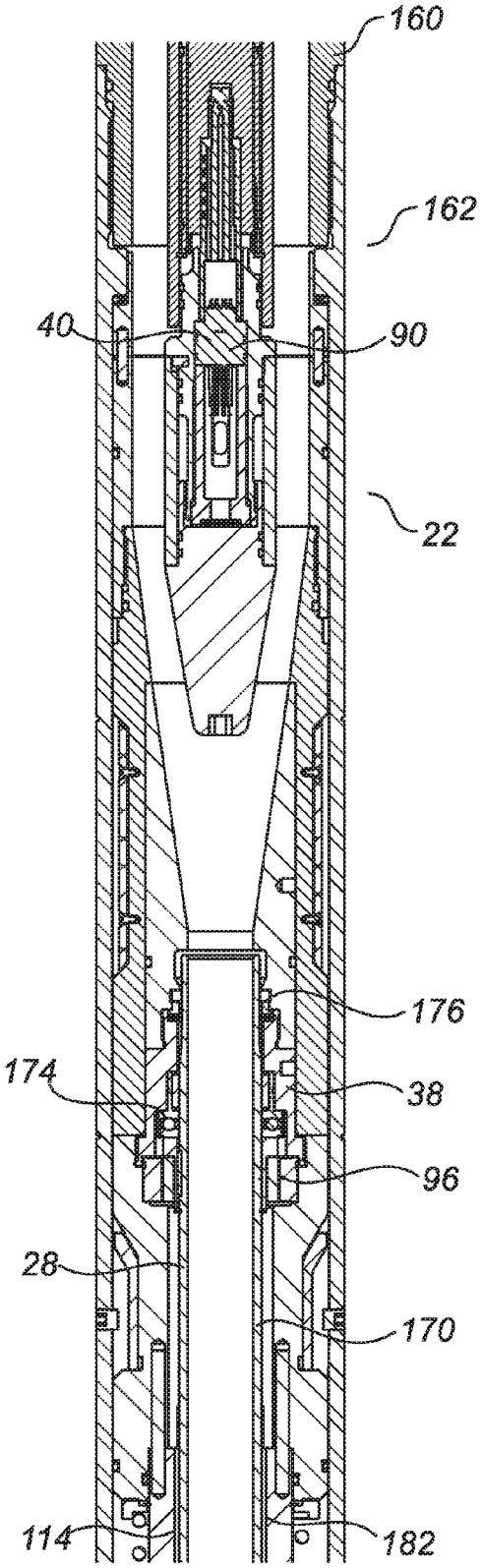
FIG. 7C is a continuation of FIG. 7B.
Figure 7D:
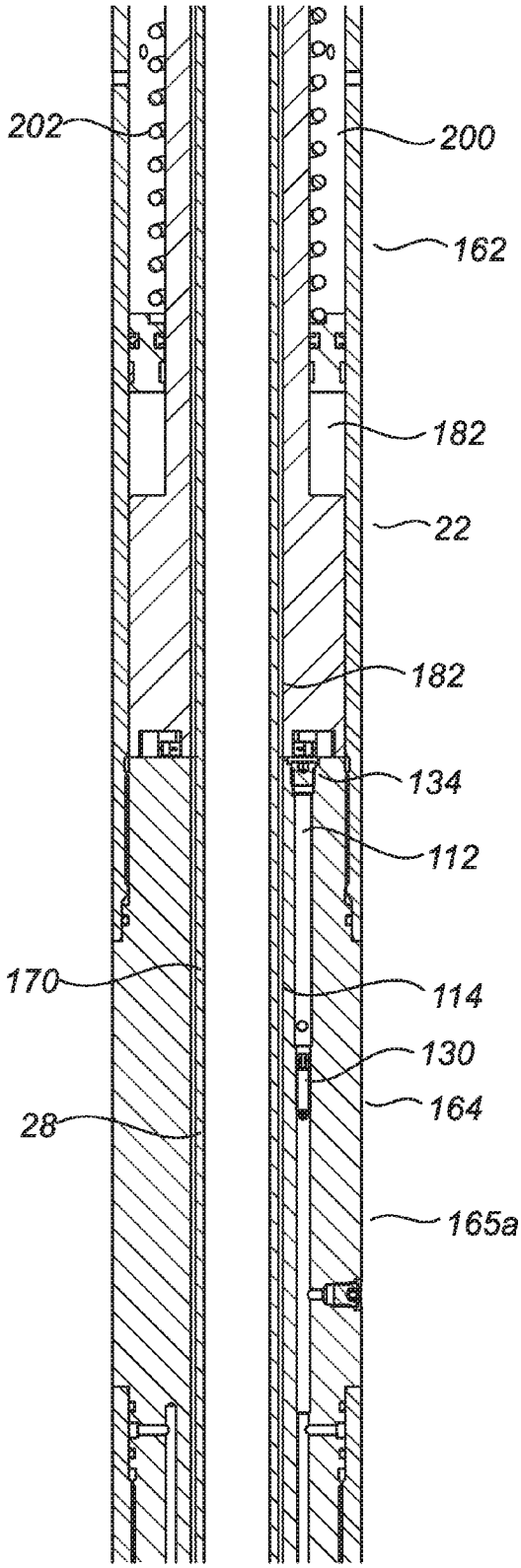
FIG. 7D is a continuation of FIG. 7C.
Figure 8:
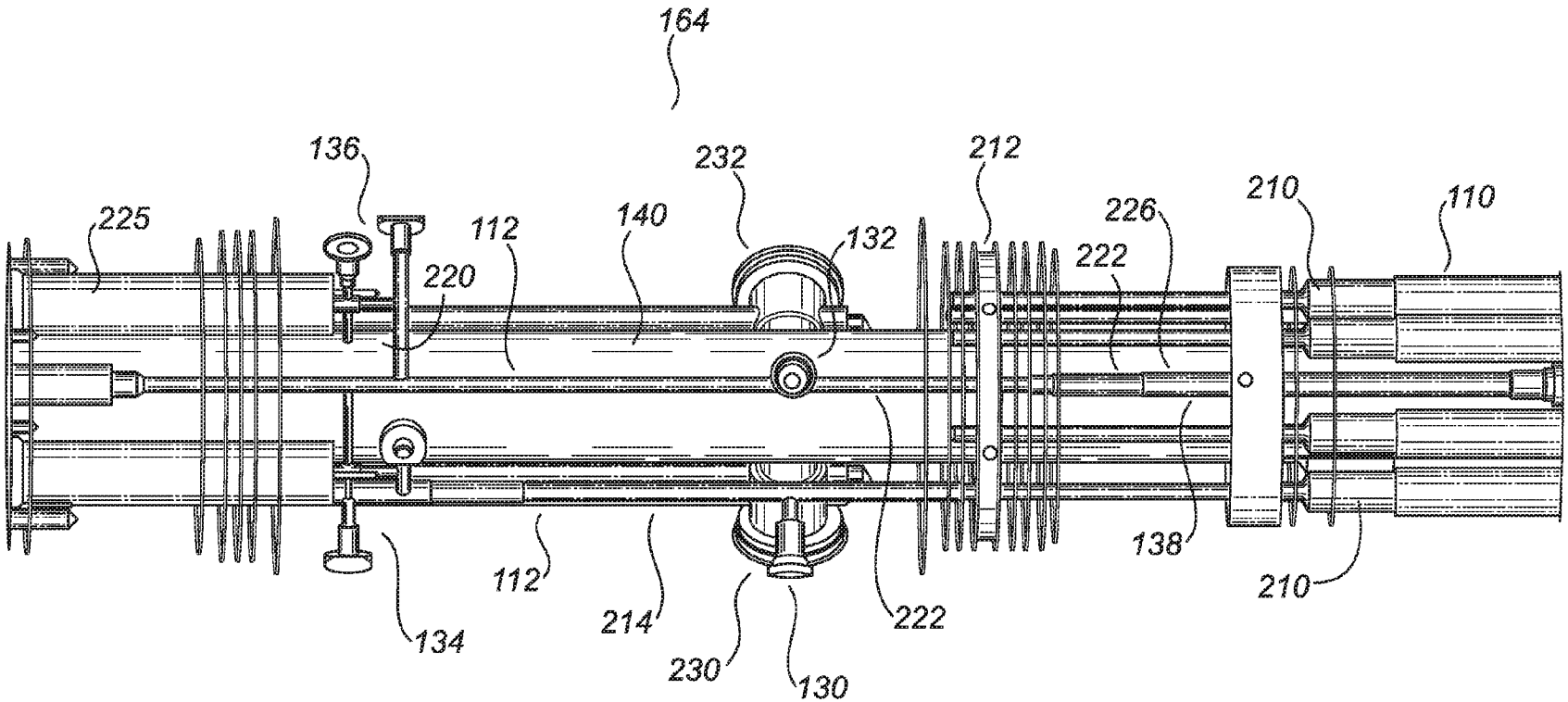
FIG. 8 is a first pictorial schematic drawing of features of the reactive torque control device in the embodiment of the apparatus of the invention depicted in FIG. 7.
Figure 9:
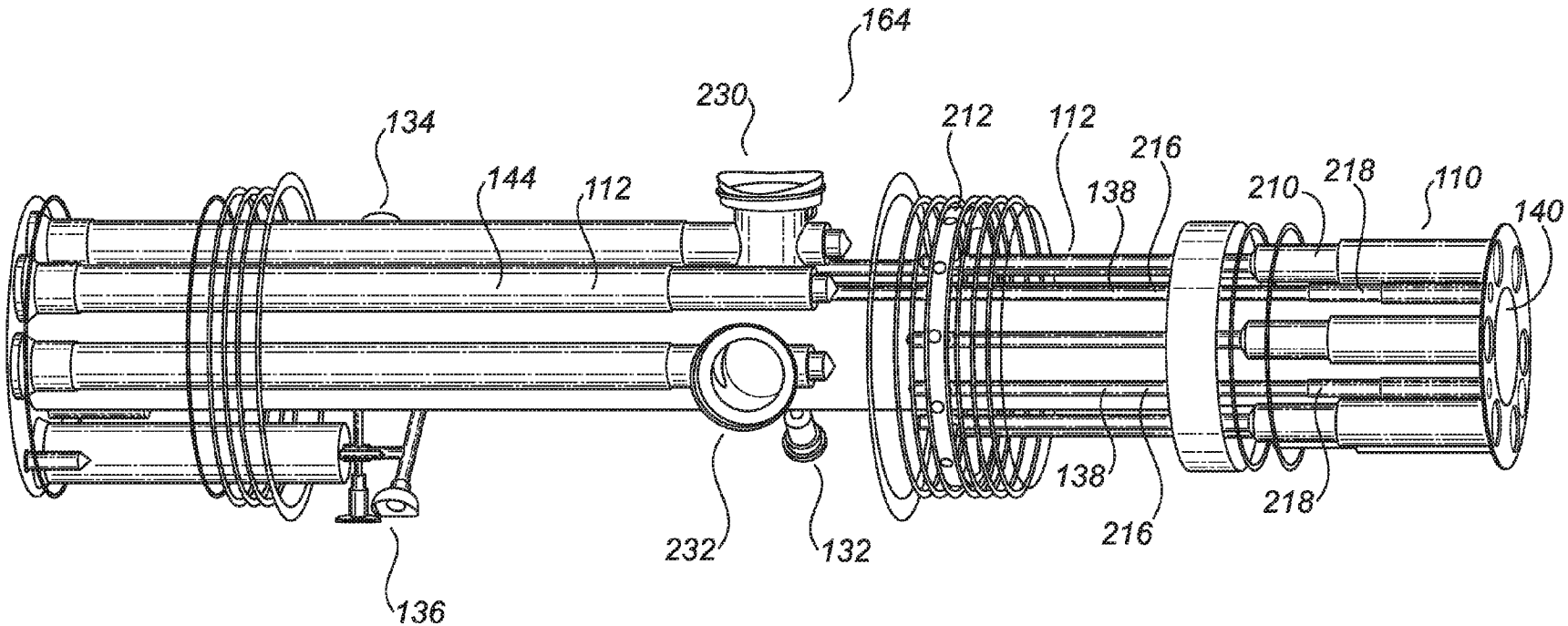
FIG. 9 is a second pictorial schematic drawing of features of the reactive torque control device in the embodiment of the apparatus of the invention depicted in FIG. 7 from a different viewing position than that of FIG. 8.

FIG. 7 is a longitudinal section assembly drawing of one example of an embodiment of the apparatus (20), which provides a detailed view of the components of the exemplary apparatus (20). FIG. 8 is a pictorial schematic drawing of components of the reactive torque control device (38), shown in isolation from the remainder of the apparatus (20). FIG. 9 is a pictorial schematic drawing of components of the reactive torque control device (38), shown in isolation from the remainder of the apparatus (20) and rotated approximately 180 degrees relative to FIG. 8.

The reference numbers used above will be used in the description that follows to the extent that the previously used reference numbers relate to equivalent structures in the particular embodiment.

Referring to FIG. 7, the upper assembly (22) is comprised of several components connected end to end with threaded connections. Beginning at the upper end (24) of the upper assembly (22), the upper assembly (22) includes a sonde sub (160), an orientation sensing assembly (162), a pump assembly (164), and a brake assembly (166). The components (160, 162,164,166) are each comprised of housings which define and/or contain parts and features of the apparatus (20). Each of the components (160,162,164,166) may be comprised of a single housing or may be comprised of a plurality of housing elements connected together.

As depicted in FIG. 7, the sonde sub (160) is comprised of a single sonde sub housing (161), the orientation sensing assembly (162) is comprised of a single orientation sensing assembly housing (163), the pump assembly (164) is comprised of a loop housing (165*a*) and a pump housing (165*b*), and the brake assembly (166) is comprised of a brake housing (167*a*), a bearing housing (167*b*) and a seal housing (167*c*).

The lower assembly (28) is comprised of an upper mandrel (170) and a lower mandrel (172) which are connected together with a threaded connection and which are rotatably mounted within the upper assembly (22) so that the upper end of the upper mandrel (170) is contained within the orientation sensing assembly (162) and so that the lower end of the lower mandrel (172) protrudes from the lower end of the brake assembly (166).

The lower assembly (28) is mounted within the upper assembly (22) with an upper bearing (174) and an upper rotary seal (176) which are contained within the orientation sensing assembly (162) and with a plurality of lower bearings (178) and a lower rotary seal (180) which are contained within the brake assembly (166). The bearings (174,178) are comprised of thrust bearings and radial bearings and facilitate the orientable rotatable connection (36) between the upper assembly (22) and the lower assembly (28). As depicted in FIG. 7, the bearings (174,178) include Kalsi™ thrust bearings manufactured by Kalsi Engineering, Inc. of Sugar Land, Tex.

The seals (176,180) provide a fluid chamber (182) within the apparatus (20) between the seals (176,180) which is isolated from fluids in the borehole (10). The fluid chamber (182) is contained with pumping fluid (114), which pumping fluid (114) also functions to lubricate components of the apparatus (20).

The lower assembly (28) further comprises a rotary drilling motor (30) which is threadably connected to the lower end of the lower mandrel (172) and a drill bit (32) which is threadably connected to the lower end of the drilling motor (30). Neither the drilling motor (30) nor the drill bit (32) are depicted in FIG. 7, but are depicted in FIGS. 1-4.

If the apparatus (20) is to be operated in a fully automated closed-loop mode and no downlink or uplink communications between the apparatus (20) and the surface location (12) are required, the sonde sub (160) may be connected directly with a drilling string (26).

If however, it is necessary or desirable to provide for downlink and/or uplink communications, the sonde sub (160) may be connected with a surface communication link (150) such as a conventional measurement-while-drilling (MWD) module (which is not shown in FIG. 7, but is depicted in FIGS. 1-4) via an adapter (190) on the sonde sub (160), in which case the surface communication link (150) provides the upper end (24) of the upper assembly (24) and is connected with the drilling string (26).

The sonde sub (160) may be a conventional electronics sub as is known in the field of well logging. The functions of the sonde sub (160) include providing components of the feedback control system (42) and providing communication between the surface communication link (150) and other components of the apparatus (20) which are located below the sonde sub (160). Specifically, the sonde sub (160) contains the feedback control system (42), including the feedback processor (70) and the reactive torque control device controller (72), and provides a portion of the feedback communication link (74) between the orientation sensing device (40) and the feedback processor (70). The sonde sub (160) also contains the memory (148). The memory (148) is connected with the feedback processor (70).

The orientation sensing assembly (162) is connected to the lower end of the sonde sub (160). The primary function of the orientation sensing assembly (162) is to contain the orientation sensing device (40). The orientation sensing assembly (162) also provides a communication link between the feedback control system (42) and the reactive torque control device (38).

The orientation sensing device (40) is comprised of an orientation sensor (90) which is comprised of a conventional electronic orientation sensor package containing accelerometers and/or magnetometers, of the type known in the field of drilling tools. Since the orientation sensor (90) is located on the upper assembly (22), it senses the actual orientation of the upper assembly (22). Consequently, the orientation sensing device (40) is further comprised of a referencing device (96) for providing a referencing orientation between the upper assembly (22) and the lower assembly (28).

The referencing device (96) is comprised of a resolver. The resolver is comprised of an inner ring and an outer ring. The inner ring is mounted on the upper mandrel (170) and the outer ring is mounted on the orientation sensing assembly (162). The relative positions of the rings provide the reference orientation between the upper assembly (22) and the lower assembly (28).

The orientation sensing device (40) therefore senses the actual orientation of the upper assembly (22) and senses a reference orientation between the upper assembly (22) and the lower assembly (28) so that the actual orientation of the lower assembly (28) can be determined.

Referring to FIG. 7, the pump assembly (164) is connected to the lower end of the orientation sensing assembly (162). The primary function of the pump assembly (164) is to contain components of the reactive torque control device (38).

An upper pressure compensation assembly (200) is also provided between the orientation sensing assembly (162) and the pump assembly (164). The upper pressure balancing assembly (200) comprising a pressure balancing chamber and a pressure balancing piston contained within the pressure balancing chamber. A fluid chamber side of the pressure balancing chamber is in fluid communication with the fluid chamber (182) and a borehole side of the pressure balancing chamber is in fluid communication with the borehole (10) so that the pressure within the borehole (10) is communicated to the fluid chamber (182) by the pressure balancing piston, thereby reducing the pressure differential across the seals (176,180). A spring (202) is provided in the borehole side of the pressure balancing chamber to provide a positive pressure differential between the fluid chamber (182) and the borehole (10).

The reactive torque control device (38) for the embodiment depicted in FIGS. 7-9 is essentially identical to the reactive torque control device (38) depicted in FIG. 6 and discussed above. Referring to FIGS. 7-9, the reactive torque control device (38) therefore includes the pump (110), the loop (112), the brake (122), the first flow restrictor (130), the second flow restrictor (132), the first valve (134), the second valve (136), the pressure relief bypass line (138), the reservoir (140), the dump valve (142) and the accumulator (144).

In the embodiment depicted in FIGS. 7-9, the pump (110) is a swash plate pump comprising six cylinders spaced circumferentially around the pump sub (164) so that the pump (110) is driven by relative rotation between the lower assembly (28) and the upper assembly (22).

In the embodiment depicted in FIGS. 7-9, the loop (112) is primarily comprised of a collection of ports and channels contained within or formed by the pump sub (164).

In the embodiment depicted in FIGS. 7-9, the flow restrictors (130,132) are both Flosert™ adjustable flow restrictors manufactured by The Lee Company, USA of Westport, Conn. The Flosert™ adjustable flow restrictors provide a constant flow rate over a wide range of pressure conditions, and can be adjusted to provide different flow rates. As depicted in FIGS. 7-9, the flow restrictors (130,132) may be adjusted to provide the same flow rates, thereby providing the same flow rate of the pumping fluid (114) toward the brake (122) as away from the brake (122). In the embodiment contemplated in FIGS. 7-9, the flow restrictors (130,132) are manually adjustable to provide a desired flow rate and thus a desired pumping resistance (116) before the apparatus (20) is deployed in the borehole (10). The flow restrictors (130,132) could, however be configured to be adjustable by the reactive torque control device controller (72).

In the embodiment depicted in FIGS. 7-9, the valves (134, 136) are both solenoid type valves which are electrically actuatable by the reactive torque control device controller (72).

Referring back to FIG. 6 and to FIGS. 8-9, the loop (112) begins with the pump (112). The pumping fluid (114) is drawn from the reservoir (140) and pumped by the pump (110) via a reservoir supply line (208) as the lower assembly (28) rotates relative to the upper assembly (22). The pumping fluid (114) passes through check valves (210) to a 360° (i.e., circular) manifold (212). Two lines extend from the manifold (212).

A first manifold line (214) extends between the manifold (212) and the first valve (134). The first flow restrictor (130) is positioned within the first manifold line (214) in order to control the flow rate of the pumping fluid (114) and to assist in providing the pumping resistance (116).

A second manifold line (216) extends between the manifold (212) and a pressure relief bypass valve (218) so that the second manifold line (216) and the pressure relief bypass valve (218) together provide the pressure relief bypass line (138). In the embodiment depicted in FIGS. 7-9, two pressure relief bypass lines (138) are provided as redundant components.

If the first valve (134) is closed, the fluid pressure in the manifold (212) will increase as the pump (110) pumps the pumping fluid (114) until the fluid pressure exceeds the bypass pressure, at which point the pumping fluid (114) will pass through the pressure relief bypass valve (218) to the reservoir (140). The reservoir (140) is comprised of the annular space which is provided between the upper assembly (22) and the lower assembly (28) along the length of the apparatus (20) between the seals (176,180).

If the first valve (134) is open, the pumping fluid (114) passes from the second manifold line (216) to a brake actuation line (220) which extends between the first valve (134) and the second valve (136).

A brake pressure line (222) extends between the brake actuation line (220) and a brake piston (224) so that the fluid pressure in the brake pressure line (222) is equal to the fluid pressure in the brake actuation line (220).

Referring to FIG. 7, the brake piston (224) and the brake (122) are contained in the brake assembly (166). The brake piston (224) abuts the first brake part (124) such that movement of the brake piston (224) in the brake pressure line (222) under the influence of fluid pressure in the brake actuation line (220) urges the first brake part (124) toward the second brake part (126), thereby providing an engagement force between the brake parts (124,126). The first brake part (124) is keyed to the upper assembly (22) so that it may reciprocate relative to the upper assembly (22) but may not rotate relative to the upper assembly (22). As the fluid pressure in the brake actuation line (220) increases, the engagement force between the brake parts (124,126) also increases.

The second flow restrictor (132) is positioned within the brake pressure line (222) between the brake (122) and the second valve (136) in order to control the flow rate of the pumping fluid (114) between the brake (122) and the reservoir (140) and in order to provide the pumping resistance (116).

If the second valve (136) is closed, the pumping fluid (214) will continue to pass through the pressure relief bypass valve (218) to the reservoir (140), with the result that the fluid pressure in the brake actuation line (220) will not exceed the bypass pressure.

If the second valve (136) is open, the pumping fluid (214) will pass from the brake actuation line (220) and the brake pressure line (222) back to the reservoir (140) via a reservoir return line (225). The second flow restrictor (132) limits the flow rate of the pumping fluid through the brake actuation line (220) and assists in providing the pumping resistance (116).

A pressure transducer (226) is positioned in the brake pressure line (222). The pressure transducer (226) senses the fluid pressure in the brake pressure line (222), which can be correlated to the engagement force between the brake parts (124,126). The pressure transducer (226) may also be connected with the feedback processor (70) so that the reactive torque control device (38) can be actuated in response to the fluid pressure in the brake pressure line (222).

In the embodiment depicted in FIGS. 7-9, the reactive torque control device (38) is further comprised of a first loop pressure compensation assembly (230) and a second loop pressure compensation assembly (232), each of which is similar in design to the upper pressure compensation assembly (200). The first loop pressure compensation assembly (230) communicates the pressure in the borehole (10) to the portion of the loop (112) which is between the pump (110) and the first valve (134). The second loop pressure compensation assembly (232) communicates the pressure in the borehole (10) to the portion of the loop (112) which is between the second valve (136) and the reservoir (140).

The lower bearing (178) is contained within the bearing housing (167*b*) of the brake assembly (166). The lower seal (180) is contained within the seal housing (167*c*) of the brake assembly (166). The lower end of the lower mandrel (172) of the lower assembly (28) extends below the lower end of the seal housing (167*c*) of the brake assembly (166).

The drilling motor (30) is directly or indirectly connected to the lower end of the lower mandrel (172) and the drill bit (32) is directly or indirectly connected to the lower end of the drilling motor (30) so that the lower assembly (28) is comprised of the drilling motor (30) and the drill bit (32). In order to facilitate directional drilling, the lower assembly (28) provides the toolface orientation (44), which in turn may be provided by a bend (46) in the lower mandrel (172), by a bend in the drilling motor (30), by a bent sub which is connected within the lower assembly (28), by a steering tool (48), or in any other suitable manner.

The reactive torque control device (38) may be selectively actuated by the reactive torque control device controller (72) either to allow rotation of the lower assembly (28) relative to the upper assembly (22) or to prevent rotation of the lower assembly (28) relative to the upper assembly (22). When the reactive torque control device (38) is actuated to allow relative rotation of the lower assembly (28) and the upper assembly (22), non-directional or "straight" drilling is facilitated. When the reactive torque control device (38) is actuated to prevent relative rotation of the lower assembly (28) and the upper assembly (22), directional drilling is facilitated by establishing and maintaining a desired toolface orientation (44) and thus a target orientation of the lower assembly (28).

The desired toolface orientation (44) (i.e., the target orientation of the lower assembly (28)) may be constant throughout drilling of the borehole (10) or may vary during drilling of the borehole (10) to provide a plurality and/or sequence of target orientations of the lower assembly (28) as part of a borehole drilling plan. The desired toolface orientation (44) may be stored in the memory (148) before deployment of the apparatus (20) or may be communicated to the feedback control system (42) and stored in the memory (148) as a downlink instruction via the surface communication link (150). A varied target orientation of the lower assembly (28) may be considered to be an updated target orientation of the lower assembly (28).

The desired toolface orientation (44) may also vary during drilling of the borehole (10) as a result of data received by the feedback control system (42) from parameter sensing devices (98) associated with the apparatus (20). For example, data relating to the composition or condition of formations being intersected during drilling, or data relating to the performance or condition of the apparatus (20) may necessitate or render desirable a change in the desired toolface orientation (44).

The apparatus (20) or other devices having certain features of the apparatus (20) may be used to perform methods of directional drilling.

As one example, embodiments of a method of directional drilling of a borehole (10) may use an apparatus (20) comprising an upper assembly (22) connected with a drilling string (26), a lower assembly (28) comprising a rotary drilling motor (30) such that the lower assembly (28) is subjected to reactive torque during drilling as a result of the operation of the drilling motor (30), an orientable rotatable connection (36) between the upper assembly (22) and the lower assembly (28), and a reactive torque control device (38) associated with the orientable rotatable connection (36), wherein the reactive torque control device (38) is actuatable to selectively allow rotation of the lower assembly (28) relative to the upper assembly (22) or prevent rotation of the lower assembly (28) relative to the upper assembly (22). The apparatus (20) may also include other features as described above with respect to the apparatus (20) of the invention.

In such embodiments, the method may comprise:

(a) actuating the reactive torque control device (38) to prevent rotation of the lower assembly (28) relative to the upper assembly (22);

(b) providing a sensed actual orientation of the lower assembly (28);

(c) comparing the sensed actual orientation of the lower assembly (28) with a target orientation of the lower assembly (28);

(d) actuating the reactive torque control device (38) to allow the lower assembly (28) to rotate relative to the upper assembly (22);

(e) operating the drilling motor (30) in order to provide the target orientation of the lower assembly (28); and (f) actuating the reactive torque control device (38) to prevent rotation of the lower assembly (28) relative to the upper assembly (22).

All or portions of the above described method may be repeated while directional drilling is being performed in order to maintain the target orientation of the lower assembly (28) and/or in order to obtain and/or maintain updated target orientations of the lower assembly (28).

In the embodiment of the apparatus (20) as depicted in FIGS. 7-9, the reactive torque control device (38) may be actuated to allow rotation of the lower assembly (28) relative to the upper assembly (22) by providing a fluid pressure in the brake pressure line (222) which is less than a locking pressure which is required to provide an engagement force between the brake parts (124,126) which is less than that which is required to prevent relative rotation of the lower assembly (28) and the upper assembly (22).

Such a fluid pressure may be achieved by selectively actuating the valves (134,136). As one example, the first valve (134) may be actuated to the closed position while the second valve (136) is actuated to the open position. As a second example, both valves (134,136) may be actuated to the closed position while the fluid pressure in the brake pressure line (222) is less than the locking pressure. As a third example, both valves (134,136) may be actuated to the open position if the pumping resistance (116) in the loop (112) provides a fluid pressure in the brake pressure line (222) while the pumping fluid (114) is being pumped around the loop (112) which is less than the locking pressure.

In the embodiment of the apparatus (20) as depicted in FIGS. 7-9, the reactive torque control device (38) may be actuated to prevent rotation of the lower assembly (28) relative to the upper assembly (22) by providing a fluid pressure in the brake pressure line (222) which is greater than or equal to a locking pressure which is required to provide an engagement force between the brake parts (124,126) which is greater than that which is required to prevent relative rotation of the lower assembly (28) and the upper assembly (22).

Such a fluid pressure may be achieved by selectively actuating the valves (134,136). As one example, the first valve (134) may be actuated to the open position while the second valve (136) is actuated to the closed position, thereby causing the fluid pressure in the brake pressure line (222) to increase to the locking pressure (which locking pressure is less than or equal to the bypass pressure as determined by the pressure relief bypass line (138)). The first valve (134) may then be closed in order to "trap" the locking pressure in the brake pressure line (222).

The reactive torque control device (38) will remain actuated to prevent relative rotation of the lower assembly (28) relative to the upper assembly (22) until the fluid pressure in the brake pressure line (222) is reduced below the locking pressure. This may be achieved by actuating the second valve (136) to the open position in order to permit the pumping fluid (114) to move from the brake pressure line (222) back to the reservoir (140). claimed are defined as follows:

The embodiments of the invention in which an exclusive property or privilege is:

1. An apparatus for use in drilling a borehole, the apparatus comprising:

(a) an upper assembly which is connectable with a drilling string;

(b) a lower assembly comprising a rotary drilling motor such that the lower assembly is subjected to a reactive torque during drilling as a result of the operation of the drilling motor;

(c) an orientable rotatable connection between the upper assembly and the lower assembly;

(d) a reactive torque control device associated with the orientable rotatable connection, wherein the reactive torque control device is actuatable to selectively allow rotation of the lower assembly relative to the upper assembly or prevent rotation of the lower assembly relative to the upper assembly, wherein the reactive torque control device is comprised of a pump and wherein the pump is driven by relative rotation between the lower assembly and the upper assembly;

(e) an orientation sensing device for providing a sensed actual orientation of the lower assembly;

(f) a feedback control system associated with the reactive torque control device and the orientation sensing device, for actuating the reactive torque control device in response to the sensed actual orientation of the lower assembly in order to achieve a target orientation of the lower assembly, wherein the feedback control system is a component of one of the upper assembly and the lower assembly; and (g) at least one parameter sensing device, for sensing a parameter other than the actual orientation of the lower assembly and for providing a sensed parameter value relating to the parameter.

2. The apparatus as claimed in claim 1 wherein the feedback control system is comprised of a feedback processor for processing the sensed actual orientation of the lower assembly in order to generate a feedback actuation instruction for actuating the reactive torque control device in order to achieve the target orientation of the lower assembly.

3. The apparatus as claimed in claim 2 wherein the feedback control system is further comprised of a reactive torque control device controller for receiving the feedback actuation instruction and for actuating the reactive torque control device in order to implement the feedback actuation instruction.

4. The apparatus as claimed in claim 3 wherein the feedback control system is further comprised of a feedback communication link between the orientation sensing device and the feedback processor, for transmitting the sensed actual orientation of the lower assembly from the orientation sensing device to the feedback processor.

5. The apparatus as claimed in claim 4 wherein the lower assembly provides a toolface orientation for facilitating directional drilling.

6. The apparatus as claimed in claim 5 wherein the toolface orientation is provided by a bend associated with the lower assembly.

7. The apparatus as claimed in claim 5 wherein the orientation sensing device is comprised of an orientation sensor associated with the lower assembly such that the orientation sensor is a component of the lower assembly.

8. The apparatus as claimed in claim 7 wherein the feedback processor is associated with the upper assembly such that the feedback processor is a component of the upper assembly.

9. The apparatus as claimed in claim 8 wherein the feedback communication link is comprised of a wireline between the orientation sensor and the feedback processor.

10. The apparatus as claimed in claim 9 wherein the feedback communication link is further comprised of a rotatable signal coupler between the orientation sensor and the feedback processor.

11. The apparatus as claimed in claim 10 wherein the rotatable signal coupler is comprised of a slip ring.

12. The apparatus as claimed in claim 8 wherein the reactive torque control device controller is associated with the upper assembly such that the reactive torque control device controller is a component of the upper assembly.

13. The apparatus as claimed in claim 5 wherein the reactive torque control device is further comprised of a loop containing a pumping fluid, wherein the relative rotation between the lower assembly and the upper assembly causes the pump to pump the pumping fluid around the loop, wherein the loop is comprised of a pumping resistance, and wherein the pumping resistance loads the pump and thereby impedes the relative rotation between the lower assembly and the upper assembly.

14. The apparatus as claimed in claim 13 wherein the pumping resistance is adjustable.

15. The apparatus as claimed in claim 13 wherein the pumping resistance is comprised of a flow restrictor positioned in the loop.

16. The apparatus as claimed in claim 15 wherein the flow restrictor is adjustable.

17. The apparatus as claimed in claim 16 wherein the flow restrictor is adjustable by the reactive torque control device controller.

18. The apparatus as claimed in claim 13 wherein the loop may be selectively blocked in order to prevent the pumping fluid from being pumped around the loop by the pump.

19. The apparatus as claimed in claim 13 wherein the reactive torque control device is further comprised of a valve positioned in the loop and wherein the valve may be actuated between an open position and a closed position in which the loop is blocked in order to prevent the pumping fluid from being pumped around the loop by the pump.

20. The apparatus as claimed in claim 19 wherein the valve is actuatable by the reactive torque control device controller.

21. The apparatus as claimed in claim 13 wherein the pump is a swash plate pump.

22. The apparatus as claimed in claim 13 wherein the reactive torque control device is further comprised of a brake associated with the loop, wherein the brake is comprised of a first brake part associated with the upper assembly and a second brake part associated with the lower assembly, and wherein the brake is actuated by a fluid pressure in the loop.

23. The apparatus as claimed in claim 22 wherein the first brake part and the second brake part are urged into engagement with each other as a result of the fluid pressure in the loop, thereby providing an engagement force between the first brake part and the second brake part which impedes the relative rotation between the lower assembly and the upper assembly, and wherein the engagement force between the first brake part and the second brake part increases as the fluid pressure in the loop increases.

24. The apparatus as claimed in claim 23 wherein the pumping resistance is comprised of a first flow restrictor positioned in the loop on an upstream side of the brake and a second flow restrictor positioned in the loop on a downstream side of the brake.

25. The apparatus as claimed in claim 23 wherein the reactive torque control device is further comprised of a first valve positioned in the loop on an upstream side of the brake and a second valve positioned in the loop on a downstream side of the brake, and wherein the first valve and the second valve may each be actuated between an open position and a closed position in which the loop is blocked between the first valve and the second valve in order to maintain the engagement force between the first brake part and the second brake part.

26. The apparatus as claimed in claim 25 wherein the loop is comprised of a pressure relief bypass line positioned in the loop for bypassing the first valve and the second valve when the fluid pressure in the loop exceeds a bypass pressure as determined by the pressure relief bypass line.

27. The apparatus as claimed in claim 26 wherein the loop is further comprised of a dump valve for releasing an amount of the pumping fluid from the loop when the fluid pressure in the loop exceeds a dump pressure as determined by the dump valve.

28. The apparatus as claimed in claim 27 wherein the reactive torque control device is further comprised of an accumulator in communication with the loop, for supplying additional pumping fluid to the loop when the fluid pressure in the loop is below an accumulator threshold pressure as determined by the accumulator.

29. The apparatus as claimed in claim 25 wherein the first valve and the second valve are both actuatable by the reactive torque control device controller.

30. The apparatus as claimed in claim 5 wherein the orientation sensing device is comprised of an orientation sensor associated with the upper assembly such that the orientation sensor is a component of the upper assembly and such that the orientation sensor provides a sensed actual orientation of the upper assembly.

31. The apparatus as claimed in claim 30 wherein the orientation sensing device is further comprised of a referencing device for providing a reference orientation between the upper assembly and the lower assembly so that the sensed actual orientation of the lower assembly can be obtained from the sensed actual orientation of the upper assembly.

32. The apparatus as claimed in claim 31 wherein the feedback processor is associated with the upper assembly such that the feedback processor is a component of the upper assembly.

33. The apparatus as claimed in claim 32 wherein the reactive torque control device controller is associated with the upper assembly such that the reactive torque control device controller is a component of the upper assembly.

34. The apparatus as claimed in claim 5 wherein the feedback control system is further comprised of a memory for storing the target orientation of the lower assembly.

35. The apparatus as claimed in claim 5, further comprising a surface communication link between a surface location and the feedback control system, for communicating a downlink instruction from the surface location to the feedback control system.

36. The apparatus as claimed in claim 35 wherein the surface communication link communicates an uplink communication from the feedback control system to the surface location.

37. The apparatus as claimed in claim 35 wherein the surface communication link is comprised of a measurement-while-drilling telemetry system.

38. The apparatus as claimed in claim 35 wherein the surface communication link is comprised of a pressure pulse telemetry system.

39. The apparatus as claimed in claim 35 wherein the surface communication link is comprised of a fluid flowrate telemetry system comprising a turbine and a rotation sensor for sensing a rotational speed of the turbine.

40. The apparatus as claimed in claim 35 wherein the feedback control system is further comprised of a memory for storing the downlink instruction.

41. The apparatus as claimed in claim 40 wherein the downlink instruction is comprised of the target orientation of the lower assembly.

42. The apparatus as claimed in claim 5 wherein the drilling string is comprised of a coiled tubing and wherein the upper assembly is connected with the coiled tubing.

43. The apparatus as claimed in claim 5 wherein the upper assembly is comprised of an upper section, a lower section adjacent to the orientable rotatable connection, and a swivel connection between the upper section and the lower section so that the upper section is rotatable relative to the lower section.

44. The apparatus as claimed in claim 43 wherein the lower section of the upper assembly is comprised of a rotation restraining device for restraining the lower section of the upper assembly from rotating relative to the borehole.

45. The apparatus as claimed in claim 5 wherein the reactive torque control device is actuatable between a first position which provides a minimum resistance to rotation of the lower assembly relative to the upper assembly and a second position which provides a maximum resistance to rotation of the lower assembly relative to the upper assembly, wherein rotation of the lower assembly relative to the upper assembly is allowed when the reactive torque control device is actuated to the first position, and wherein rotation of the lower assembly relative to the upper assembly is prevented when the reactive torque control device is actuated to the second position.

46. The apparatus as claimed in claim 45 wherein the reactive torque control device is actuatable to at least one intermediate position between the first position and the second position, which intermediate position provides an intermediate resistance to rotation of the lower assembly relative to the upper assembly.

47. The apparatus as claimed in claim 45 wherein the reactive torque control device is actuatable to a plurality of intermediate positions between the first position and the second position in order to provide a variable intermediate resistance to rotation of the lower assembly relative to the upper assembly.

48. The apparatus as claimed in claim 1 wherein the at least one parameter sensing device is associated with the feedback control system so that the feedback control system actuates the reactive torque control device in response to the sensed parameter value.

49. The apparatus as claimed in claim 1 wherein the reactive torque control device is actuatable to selectively allow rotation of the lower assembly relative to the upper assembly in order to facilitate non-directional drilling, and wherein the reactive torque control device is actuatable to selectively prevent rotation of the lower assembly relative to the upper assembly in order to facilitate directional drilling.

50. A method of directional drilling of a borehole using an apparatus comprising an upper assembly connected with a drilling string, a lower assembly comprising a rotary drilling motor such that the lower assembly is subjected to reactive torque during drilling as a result of the operation of the drilling motor, an orientable rotatable connection between the upper assembly and the lower assembly, and a reactive torque control device associated with the orientable rotatable connection, wherein the reactive torque control device is actuatable to selectively allow rotation of the lower assembly relative to the upper assembly or prevent rotation of the lower assembly relative to the upper assembly, wherein the reactive torque control device is comprised of a pump, and wherein the pump is driven by relative movement between the lower assembly and the upper assembly, the method comprising the following:

(a) actuating the reactive torque control device to prevent rotation of the lower assembly relative to the upper assembly;

(b) providing a sensed actual orientation of the lower assembly to a feedback control system, wherein the feedback control system is a component of one of the upper assembly and the lower assembly;

(c) comparing the sensed actual orientation of the lower assembly with a target orientation of the lower assembly;

(d) actuating the reactive torque control device with the feedback control system to allow the lower assembly to rotate relative to the upper assembly;

(e) operating the drilling motor in order to provide the target orientation of the lower assembly; and (f) actuating the reactive torque control device with the feedback control system to prevent rotation of the lower assembly relative to the upper assembly.

51. The method as claimed in claim 50 wherein the lower assembly provides a toolface orientation for facilitating the directional drilling.

52. The method as claimed in claim 51 wherein the toolface orientation is provided by a bend associated with the lower assembly.

53. The method as claimed in claim 51 wherein the upper assembly is comprised of an upper section, a lower section adjacent to the orientable rotatable connection, and a swivel connection between the upper section and the lower section so that the upper section is rotatable relative to the lower section, further comprising rotating the upper section of the upper assembly while operating the drilling motor.

54. The method as claimed in claim 53, further comprising restraining the lower section of the upper assembly from rotating relative to the borehole.

55. The method as claimed in claim 51, further comprising communicating a downlink instruction to the apparatus, wherein the downlink instruction is comprised of the target orientation of the lower assembly.

56. The method as claimed in claim 55 wherein the target orientation of the lower assembly is comprised of an updated target orientation of the lower assembly.

57. The method as claimed in claim 55 wherein the downlink instruction is comprised of a sequence of target orientations of the lower assembly.

58. The method as claimed in claim 51, further comprising repeating (b) through (f) while the directional drilling is being performed.

59. The method as claimed in claim 58, further comprising communicating a downlink instruction to the apparatus, wherein the downlink instruction is comprised of the target orientation of the lower assembly.

60. The method as claimed in claim 58, further comprising communicating a downlink instruction to the apparatus periodically while the directional drilling is being performed, wherein the downlink instruction is comprised of the target orientation of the lower assembly.

61. The method as claimed in claim 60 wherein the target orientation of the lower assembly is an updated target orientation of the lower assembly.

62. The method as claimed in claim 60 wherein the downlink instruction is comprised of a sequence of target orientations of the lower assembly.

63. The method as claimed in claim 62 wherein (b) through (f) are repeated using an updated target orientation of the lower assembly, further comprising generating the updated target orientation of the lower assembly.

64. The method as claimed in claim 63 wherein the updated target orientation of the lower assembly is generated using data from at least one sensing device associated with the apparatus.

65. The method as claimed in claim 64 wherein the updated target orientation of the lower assembly is generated by the feedback control system.

66. The method as claimed in claim 51 wherein the sensed actual orientation of the lower assembly is provided by obtaining a sensed actual orientation of the upper assembly and a reference orientation between the upper assembly and the lower assembly.

67. The method as claimed in claim 51, further comprising communicating an uplink communication from the apparatus, wherein the uplink communication is comprised of the sensed actual orientation of the lower assembly.

68. The method as claimed in claim 67, further comprising communicating a downlink instruction to the apparatus, wherein the downlink instruction is comprised of the target orientation of the lower assembly.

69. The method as claimed in claim 51 wherein the reactive torque control device is actuatable between a first position which provides a minimum resistance to rotation of the lower assembly relative to the upper assembly and a second position which provides a maximum resistance to rotation of the lower assembly relative to the upper assembly and wherein actuating the reactive torque control device to prevent rotation of the lower assembly relative to the upper assembly is comprised of actuating the reactive torque control device to the second position.

70. The method as claimed in claim 69 wherein the reactive torque control device is actuatable to at least one intermediate position between the first position and the second position, which intermediate position provides an intermediate resistance to rotation of the lower assembly relative to the upper assembly, and wherein actuating the reactive torque control device to allow the lower assembly to rotate relative to the upper assembly is comprised of actuating the reactive torque control system to the intermediate position.

71. The method as claimed in claim 69 wherein the reactive torque control device is actuatable to a plurality of intermediate positions between the first position and the second position in order to provide a variable intermediate resistance to rotation of the lower assembly relative to the upper assembly, and wherein actuating the reactive torque control device to allow the lower assembly to rotate relative to the upper assembly is comprised of actuating the reactive torque control device to one of the intermediated positions.

* * * * *